United States Patent [19]

Saijo et al.

[11] Patent Number: 4,679,874

[45] Date of Patent: Jul. 14, 1987

[54] CONNECTOR HOUSING

[75] Inventors: Eiji Saijo; Shigekazu Wakata, both of Yokkaichi, Japan

[73] Assignee: Tokai Electric Wire Company Limited, Japan

[21] Appl. No.: 783,796

[22] Filed: Oct. 3, 1985

Related U.S. Application Data

[63] Continuation of Ser. No. 573,405, Jan. 24, 1984, abandoned.

[30] Foreign Application Priority Data

Jan. 27, 1983 [JP] Japan ..... 58-10428[U]

[51] Int. Cl.[4] ..... H01R 11/00

[52] U.S. Cl. ..... 439/595

[58] Field of Search ..... 339/59 R, 59 M, 61 R, 339/61 M, 63 R, 63 M, 217 S

[56] References Cited

U.S. PATENT DOCUMENTS 3,693,134 9/1972 Trevisiel ..... 339/59 M
3,842,388 10/1974 Harwood et al. ..... 339/59 R
4,114,971 9/1978 Heimbrock ..... 339/59 R
4,253,718 3/1981 Bungo ..... 339/59 R

FOREIGN PATENT DOCUMENTS 52-112791 9/1977 Japan .
53-50866 12/1978 Japan .
2062979 5/1981 United Kingdom ..... 339/59 M

*Primary Examiner*—Gil Weidenfeld
*Assistant Examiner*—Paula A. Austin
*Attorney, Agent, or Firm*—Harness, Dickey & Pierce

[57] ABSTRACT

A connector housing has a locking mechanism. The locking mechanism has a plate-like movable locking member provided through a thin hinge formed closer to the front of the connector housing. The movable locking member has a locking pawl at its free end and a locking portion which is formed in its inner surface and adapted to engage with a locking projection formed on a terminal. The locking pawl is adapted to engage, for locking, with a shoulder formed at the rear end of the connector housing.

10 Claims, 5 Drawing Figures

CONNECTOR HOUSING

This application is a continuation of application Ser. No. 573,405, filed Jan. 24, 1984, now abandoned.

FIELD OF THE INVENTION

The present invention relates to a connector housing, and more particularly, to a connector housing having a movable locking member for fixing a terminal received thereby.

DESCRIPTION OF THE PRIOR ARTS

Figure 1:
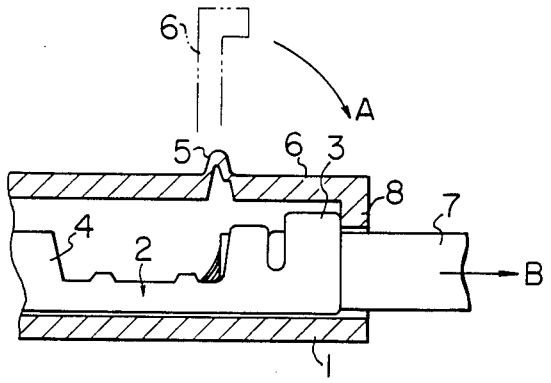
FIG. 1 PRIOR ART
FIGS. 1 and 2 are front elevational views of conventional locking mechanisms of connector housings, respectively.
Figure 2:
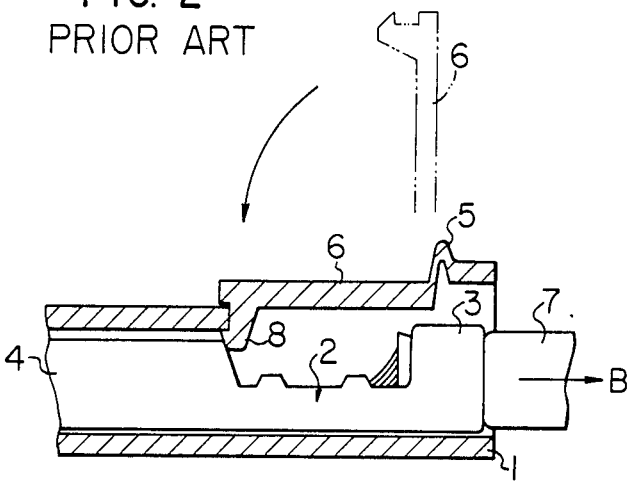
FIG. 2 PRIOR ART

Hitherto, various means have been employed for fixing a terminal received by a connector housing (referred to as simply "housing", hereinafter) so that the terminal will not come off from the housing. Examples of the fixing means include locking mechanisms, such as those mentioned in the specifications of Japanese Utility Model Publication No. 50866/1978 and Japanese Patent Laid-Open No. 112791/1977, in which the housing is provided with a lid-like locking member which is movable through a hinge, and the lid-like locking member having closed an opening in the housing and a projection formed on the terminal received thereby are engaged with each other to prevent the terminal from coming off from the housing. To sum up, these prior arts are classified into two types as shown in FIGS. 1 and 2, respectively. More specifically, the prior art shown in FIG. 1 is a front hinge type locking mechanism wherein a housing 1 has a lid-like locking member 6 which is adapted to be movable as shown by the illustrated arrow A through a hinge 5 provided closer to the front of the housing 1 so as to close an opening in the rear end portion of the housing 1, and wherein the rear edge of a pressing member 3 of a terminal 2 received by the housing 1 and a locking projection 8 formed at the free end of the lid-like locking member 6 in the closing state are engaged with each other to prevent the terminal 2 from coming off from the housing 1. On the other hand, the prior art shown in FIG. 2 is a rear hinge type locking mechanism wherein the housing 1 has the lid-like locking member 6 which is adapted to be movable through the hinge 5 provided at the rear end edge portion of the housing 1 so as to close an opening formed in front of the hinge 5, and wherein the rear edge of a contact portion 4 of the terminal 2 received by the housing 1 and the locking projection 8 of the lid-like locking member 6 in the closing state are engaged with each other to prevent the terminal 2 from coming off from the housing 1. These prior arts, however, have the following disadvantages: In the front hinge type locking mechanism, when a wire 7 is under a load applied in the direction in which the wire 7 comes off, i.e., the direction of the illustrated arrow B, a bending moment is generated in the lid-like locking member 6 in the direction for undoing the locked state, and the hinge 5 is under a tensile load. In consequence, the locked state is easily undone, and the hinge 5 is readily broken, inconveniently. Moreover, since the locking projection 8, which is to be engaged with the rear end edge of the pressing member 3, is provided, the housing 1 is increased in length in vain, disadvantageously. In the rear hinge type locking mechanism, on the other hand, when the wire 7 is under a load applied in the direction in which the wire 7 comes off, i.e., the direction of the illustrated arrow B, the hinge 5, which is thin, is readily compressed so that the locked state may be easily undone. In addition, since the rear end upper edge of the contact portion 4 and the locking projection 8 are engaged with each other, when the wire 7 is under the load applied in the direction of the arrow B, the terminal 2 easily rotates in the housing 1 (according to the clearance between the terminal 2 and the housing 1) to take an undesirable posture, which adversely affects the fitting condition between the contact portion 4 and the contact portion of the other terminal fitted with the contact portion 4, so that the electrical performance may be remarkably lowered. Particularly, when the load is large, the contact portion 4 may be deformed to fatally impair the electrical contact condition between the contact portion 4 and the contact portion of the other terminal, resulting in a deadly damage to the electrical performance.

Further, each of the lid-like locking members 6 in the locking mechanisms shown in FIGS. 1 and 2 is formed so as to be substantially perpendicular to the outer surface of the housing 1 in a free state as shown by dotted line, and is bent 90° to close the opening in use. In consequence, the lid-like locking member 6 is used with a high bending stress generated in the hinge 5, as a supporting point for rotation, by the 90° bending for the closing operation. In addition, any load applied to the wire 7 in the direction of the arrow B when the housing 1 is used causes a tensile or compressive stress to be imposed on the hinge 5 in accordance with the above-mentioned locking relationship. Therefore, the hinge 5, which is thin, may break when the imposed stress exceeds the mechanical strength thereof. Moreover, when transported before use or carried during a process, the housings 1, having the respective lid-like locking members 6 in the free state, are unfavorably bulky, and the locking members 6 are in contact and confounded with each other, which may cause the locking members 6 to be broken at the hinges 5, disadvantageously.

SUMMARY OF THE INVENTION

Accordingly, it is an object of the invention to overcome the above-mentioned disadvantages of the prior arts thereby to improve the locking performance of the terminal and to provide a connector housing capable of stably maintaining the electrical performance.

It is another object of the invention to provide a novel connector housing improved to minimize the bending stress in use and facilitate transportation and the like.

To these ends, according to one aspect of the invention, there is provided a connector housing having a locking mechanism comprising: a plate-like movable locking member provided through a thin hinge formed closer to the front of the connector housing, the movable locking member having a locking pawl at its free end and a locking portion which is formed in its inner surface and adapted to engage with a locking projection formed on a terminal, the locking pawl being adapted to engage, for locking, with a shoulder formed at the rear end of the connector housing.

Moreover, according to another aspect of the invention, there is provided a connector housing comprising: a terminal-housing chamber; an opening communicating with the terminal-housing chamber; and a movable locking member, for closing the opening, provided at one end edge of the opening through a thin hinge, the movable locking member being formed in such an inclined position as to make an acute angle with respect to the opening in a free state.

Figure 3:
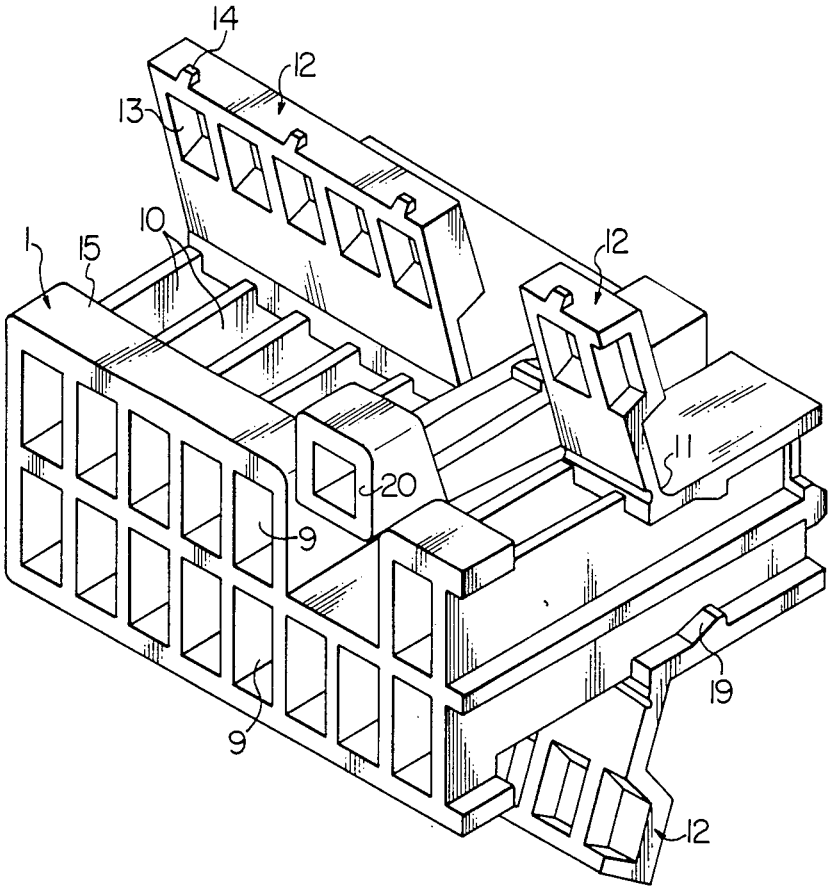
FIG. 3 is a perspective view of an embodiment of the invention.
Figure 4:
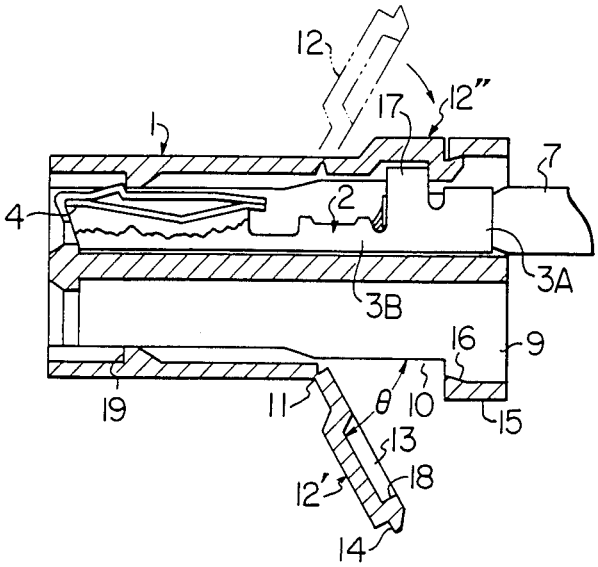
FIG. 4 is a longitudinal sectional view of the embodiment shown in FIG. 3.
Figure 5:
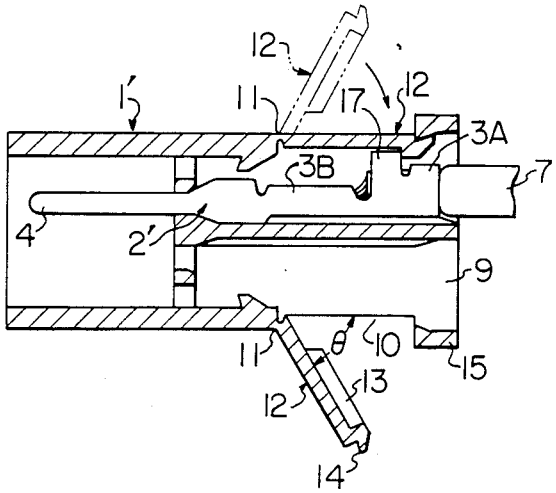
FIG. 5 is a longitudinal sectional view of another embodiment of the invention.

The above and other objects, features and advantages of the invention will become clear from the following description of the preferred embodiments thereof taken in conjunction with FIGS. 3 to 5.

DETAILED DESCRIPTION OF THE PREFERRED EMBODIMENTS

The invention will be described hereinunder through embodiments with reference to FIGS. 3 to 5.

Referring first to FIGS. 3 and 4 which in combination show an embodiment of the invention adapted for receiving a multiplicity of female terminals 2, a housing 1 has openings 10, formed closer to its rear end (the side where the terminals 2 are received), communicating with housing chambers 9 for housing the terminals 2, respectively. A lid-like movable locking member 12 is integrally provided at the front end edges of the openings 10 through a thin hinge 11 made of the same material as that for the housing 1. In a free state, the movable locking member 12 is in a position inclined at an acute angle $\theta$ of about 45° with respect to the outer surface of the housing 1 as at 12′ in FIG. 4. When the terminals 2 are received by the respective housing chambers 9, the movable locking member 12 constitutes a plate-like lid member which closes the openings 10 and is locked as at 12″ in FIG. 4. More specifically, the movable locking member 12 can be opened and closed at will through the hinge 11. The movable locking member 12 has locking pawls 14 projected from its free end. The locking pawls 14 engage with the undersurface of a beltlike shoulder 15 formed at the rear end edge of the housing 1, described later, when the movable locking member 12 is in the closing state 12″ to lock the movable locking member 12 having closed the openings 10 so that the movable locking member 12 will not open undesirably. It is to be noted that the arrangement is such that when the movable locking member 12 is slightly pressed in the closing operation the locking pawls 14 interfere with the shoulder 15 to slightly deform the movable locking member 12 until the locking pawls 14 fit with the undersurface of the shoulder 15. In addition, the movable locking member 12 has recessed locking portions 13 formed in its inner surface. Each locking portion 13 is adapted to receive or fit with the upper end of a locking projection 17 formed between a pressing member 3A (for pressing a coating portion of a wire) and a pressing member 3B (for pressing a bare-wire portion of the wire) so that the rear end edge 18 of the locking portion 13 and the upper end portion of the locking projection 17 engage with each other. On the other hand, the beltlike shoulder 15 formed at the rear end edge of the housing 1 is constructed such that the front edge of the shoulder 15 defines the rear edges of the openings 10, and the under-surface of the shoulder 15 engages with the locking pawls 14 of the movable locking member 12 in the closing state as mentioned above. The shoulder 15 is provided at its undersurface with a slanting surface 16 slightly increased in height toward the openings 10 in order to improve the locking force between the undersurface of the shoulder 15 and the locking pawls 14. The above-mentioned movable locking member 12 and shoulder 15 in combination constitute a terminal-locking mechanism that fixes the position of the received terminal 2 so that it will never come off from the housing 1. It is to be noted that the movable locking member 12 may be an integral locking member common to a multiplicity of housing chambers 9 placed in parallel with each other as shown in FIG. 3, or may be individually provided according to the arrangement of the housing chamber 9 (see the movable locking member at the upper right end in FIG. 3). In the drawings, a reference numeral 20 denotes a known locking member used when the housing 1 is connected to the other housing receiving male terminals, while a numeral 19 represents a known lancing projection which fits with an engaging bore formed in each terminal 2 so as to serve as another locking mechanism for the terminal 2.

On the other hand, FIG. 5 shows another embodiment of the invention. Shown in the drawing is a housing 1′ to be connected with the housing 1, shown in FIG. 4, having the female terminal 2 received therein. Similarly to the above-described embodiment, the housing 1′ receives a male terminal 2′ having a locking projection 17 formed between a pair of pressing members 3A and 3B. The housing 1′ has a locking mechanism, constituted by the movable locking member 12 and the shoulder 15, identical to the above-mentioned locking mechanism. In addition, similarly to the embodiment shown in FIG. 4, when it is in a free state, the movable locking member 12 is at an acute angle of about 45° (as shown by a symbol $\theta$) with respect to the opening 10.

In the housing of the invention, having the above-described locking mechanism, when a load is applied to the wire 7 in the direction in which the wire 7 comes off, the external force loaded on the movable locking member 12 is transmitted to the shoulder 15 in contact with the movable locking member 12. Therefore, the external force causes the engaged portion to act in the direction for increasing the locking degree. In addition, the external force is borne by the shoulder 15 having a high mechanical strength. Consequently, the movable locking member 12 will hardly be deflected in the direction of load; hence, the terminal 2 is fixed at a normal position even if it is under the load applied in the direction in which the terminal 2 comes off from the housing 1, and the thin hinge 11 is protected, without being pulled. Further, since the terminal 2 is locked by means of the locking projection 17 formed in the vicinity of its rear end when the terminal 2 is under the load applied in the direction in which it comes off from the housing 1, the displacement of the terminal 2 in the housing chamber 9 caused by the above-mentioned load (i.e., such displacement that a bending moment generated in the terminal by an external force inclines the terminal 2 in accordance with the clearance between the terminal 2 and the housing chamber 9) is minimized to make it possible to maintain an excellent contact condition between the terminal 2 and the other terminal mated therewith at the contact portion 4, thereby allowing the electrical performance to be stabilized, advantageously. Moreover, the housing of the invention is favorably decreased in overall length and reduced in size compared with the conventional structure shown in FIG. 1.

Furthermore, the housing 1 having the movable locking member 12 constructed as described above can close the opening 10 by rotating only about 45° in use, so that the bending stress generated in the hinge 11 portion is minimized. Accordingly, even if a load is applied to the wire 7 in use in the direction in which the wire 7 comes off and if a stress corresponding to the load is imposed on the hinge 11, the absolute amount of the stress at the hinge portion is so small that the hinge 11 can bear without breaking. In addition, it is possible to increase the design freedom of the movable locking member 12. For example, the mechanical strength is improved by increasing the hinge portion in thickness up to the allowable limits of bending stress. Further, since the movable locking member 12 is constructed so as to be at acute angle with respect to the opening 10 in a free state, the housing 1 has no member extremely projecting and is remarkably reduced in volume as opposed to the conventional structure. Accordingly, the bulkiness of the conventional housing is eliminated to make it possible to prevent the interference and confounding between the movable locking members and eliminate any trouble in transportation and transfer during a process, thereby facilitating transportation and the like, advantageously.

Although the invention has been described through specific terms, it is to be noted here that the described embodiments are not exclusive and various changes and modifications may be imparted thereto without departing from the scope of the invention which is limited solely by the appended claims.

What is claimed is:

1. A connector housing adapted to contain a terminal attached to a conductor, said connector housing being defined by a pair of spaced apart sidewalls defining a cavity adapted to receive the terminal, an opening formed in a top wall bridging said sidewalls and juxtaposed to said cavity, a locking member integrally connected to said top wall by a thin hinge portion and pivotal between an opened position and a closed position in which said locking member closes said top wall opening, a bridging member extending between said sidewalls at an end of said opening spaced from said thin hinge for reinforcing said connector housing, and interlocking means on said bridging member and the cantilevered end of said locking member adapted to engage and retain said locking member in its closed position.

2. A connector housing as described in claim 1 wherein the thin hinge portion is resilient and the locking member assumes an angle less than 90° relative to the connector housing when the locking member is in its open position.

3. A connector housing as described in claim 2, wherein the locking member assumes an angle about 45° when the locking member is in its open position.

4. A connector housing as described in claim 1 wherein the terminal has a locking projection engaged by a locking projection formed on the locking member for retaining the terminal in position within said connector housing.

5. A connector housing as described in claim 4 wherein the interlocking means of the locking member and the bridging members have portions that are inclined relative to a direction normal to the direction of engagement of the terminal locking projection and said locking member locking projection.

6. A connector housing as described in claim 5 wherein the interlocking means further include second portions angularly disposed to the first mentioned portions and parallel to the normal direction.

7. A connector housing as described in claim 4 wherein the connector housing is provided with a second locking portion spaced from the locking portion of the locking member and cooperable with the terminal for retaining the terminal within said connector housing.

8. A connector housing as described in claim 7 wherein the terminal has a connector portion adapted to be detachably connected to an associated terminal for forming an electrical and mechanical connection therebetween, said terminal locking projection being spaced from said connector portion.

9. A connector housing as described in claim 7 wherein the interlocking means of the locking member and the bridging member have portions that are inclined relative to a direction normal to the direction of engagement of the terminal locking projection and said locking member locking projection.

10. A connector housing as described in claim 9 wherein the interlocking means further include second portions angularly disposed to the first mentioned portion and parallel to the normal direction.

* * * * *